United States Patent [19]

Reese

[11] 4,029,264

[45] June 14, 1977

[54] CLING FILM ROLL HAVING A NODULOSE LEADING EDGE PORTION AND THE METHOD AND APPARATUS FOR PRODUCING IT

[75] Inventor: Ronald Griffith Reese, La Salle, Ill.

[73] Assignee: Union Carbide Corporation, New York, N.Y.

[22] Filed: May 3, 1976

[21] Appl. No.: 682,533

[52] U.S. Cl. ..... 242/1; 206/397; 242/54 R

[51] Int. Cl.[2] ..... B65H 81/00

[58] Field of Search ..... 242/54 R, 1; 206/389, 206/397, 412; 428/906; 53/1

[56] References Cited

UNITED STATES PATENTS

| | | | |
|---|---|---|---|
| 2,857,047 | 10/1958 | Edelson | 206/412 |
| 3,380,580 | 4/1968 | Warp | 242/1 |
| 3,592,340 | 7/1971 | Hoey | 206/289 |
| 3,945,495 | 3/1976 | Carmody | 206/397 |

*Primary Examiner*—Edward J. McCarthy
*Attorney, Agent, or Firm*—Cornelius F. O'Brien

[57] ABSTRACT

A method and apparatus for producing a novel cling film roll having a nodulose leading edge portion composed of a plurality of surface disturbances consisting of small stretched area projections obtained by compressing the film between a nodulose surface, such as sandpaper or emery cloth, and a yieldable support surface.

4 Claims, 4 Drawing Figures

FIG. 1
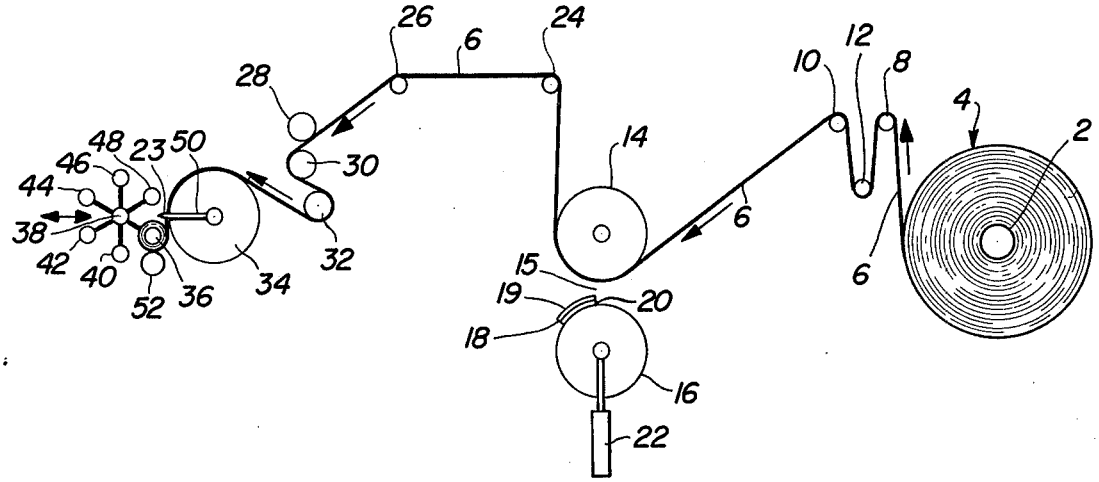
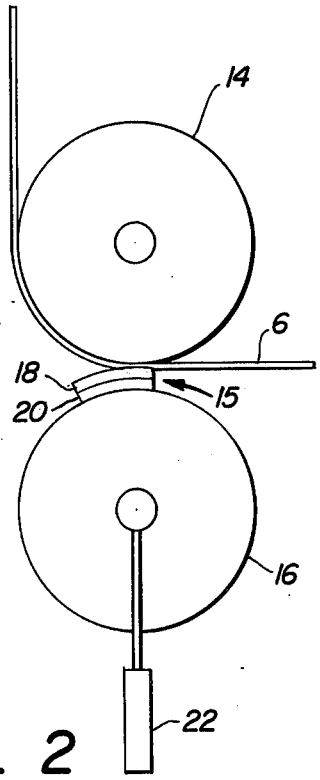
FIG. 2
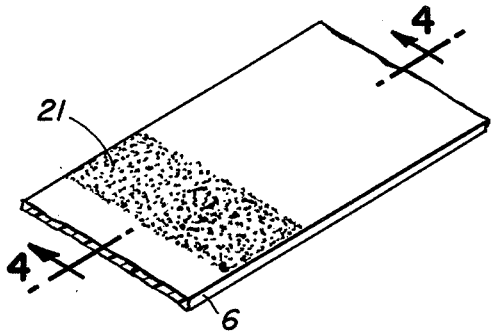
FIG. 3
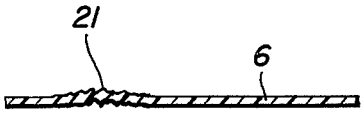
FIG. 4

CLING FILM ROLL HAVING A NODULOSE LEADING EDGE PORTION AND THE METHOD AND APPARATUS FOR PRODUCING IT

FIELD OF THE INVENTION

The invention relates to an improved method and apparatus for embossing the leading edge segment of a roll of consumer type, wrapping cling film and to the roll of film so produced.

BACKGROUND OF THE INVENTION

Thermoplastic self-supporting thin film of the kind which clings strongly to itself and other surfaces has been rolled in various lengths and sold in dispensing cartons to the public mainly for household use. Although this type of household product has found wide acceptance, one complaint has been the difficulty in locating and separating the leading edge of the cling film to initiate the start of the roll. Once the leading edge of the film is separated from the underlying layer of film, a desired length of film is peeled from the roll and severed using any of the conventional cutting means employed on the customary carton in which the roll is packed. The leading edge of the film remaining after the severing and removal of the desired length of film is usually pressed against the wall of the carton so as to be ready when an additional length of film is required. Consequently, it is the initial leading edge of a new roll of packed cling film that is difficult to locate or find and difficult to peel away to start the roll. Although film roll starting means or convenience features have been employed with some success to initiate the start of a roll, the difficulty in providing such means or features from a manufacturing standpoint has sometimes created problems for the manufacturer.

One proposed solution to solve the problem whereby the leading edge of a cling film adhere to the underlying layer of film is disclosed in U.S. Pat. No. 3,945,495. Specifically, this patent discloses the concept whereby the leading edge of the roll is treated or coated with a substance that unbalances the degree of shrinkage at the opposite surfaces of the edge such that the edge will curl, preferably away from the surface of the roll, during storage. An apparent limitation or drawback in this approach is that a coating step has to be performed on the film prior to it being packaged in a consumer type dispensing carton.

Another proposed solution is to emboss the leading edge of the roll using a conventional heat platen or strip to reduce the blocking or sticking of the edge of the film to the underlying layer. This approach, as generally discussed in U.S. Pat. No. 3,501,363, entails the feeding of the film between a heated steel roll, or platen secured to a roll, having a desired pattern etched or cut into its surface and a firm rubber-type backup roll so that by using conventional actuator means, such as a hydraulic ram, one of the rolls can be urged against the other roll thereby causing the segment of film therebetween to be heated in selected areas. This selected heating of the film results in a corresonding shrinkage of small selected areas of the film thereby imparting to the surface of the film embossed raised and depressed areas. Embossing the film in this manner at high speeds, however, is difficult since the film generally intended for consumer use is relatively fragile and may be susceptible to breaking upon contact with the heated embossing platen or roll. Another drawback is the difficulty in maintaining the precise temperature control of the platen or roll since if either is too hot, it may excessively thin the film causing proneness to tear propagation and if either is too cold, the embossing may not be distinct enough to reduce blocking or sticking of the edge to the underlying layer.

In the normal production of cling film rolls in 50 feet (15.24 meters), 100 feet (30.48 meters), 125 feet (38.10 meters) or some other preselected length, the film is usually supplied from a supply source on a continuous basis to an embossing section of an apparatus where the heated etched platen is actuated to impart selective shrinkage areas to a transverse portion of the film. The film is then further fed to a rolling and severing station where it is continuously wound on a core into preselected length rolls and severed across the embossed segment of the film so that the embossed segment of the film will form the leading edge of the completed roll. As soon as one winding cycle approaches completion, the roll of film is automatically removed and an empty core is moved into position for receiving the leading edge of the remaining film being fed. Thus preselected lenghts of rolled film are produced on a continuous basis. An apparatus for accomplishing this continuous operation is disclosed in U.S. Pat. No. 3,679,010 and is obtainable commercially from the Paper Converting Machine Company, Inc. as the 81 inches Poly Rewinder Machine 4769 . One drawback, however, is that during the operation of the apparatus, the embossed segment of the film sometimes is advanced or delayed out of proper coordination with the severing means resulting in the severing of the film at a location other than at the embossed segments. When this occurs, the apparatus is stopped and the timing for actuating the heat embossing platen has to be adjusted which usually takes about 20 minutes. In addition to this, the platens are expensive to resurface and more expensive to replace.

An object of the present invention is to provide an apparatus for continuously winding film into preselected length rolls with an embossing drum having on a transverse portion of its surface a removable projected nodulose segment which cooperates with an in-line support surface for imparting to selected transverse segments of a film strip being fed therebetween a substantially nodulose contour.

Another object of this invention is to provide a method for imparting a nodulose contour to selected transverse areas of a continuously fed film prior to the film being wound into rolls of various lengths.

Another object of this invention is to provide embossing means for use with film winding machines that is relatively inexpensive to make and requires a minimum of time to adjust.

Another object of this invention is to provide on a continuous and consistent basis rolls of cling film each having a leading edge that is readily identifiable and adapted for easy grasping to initiate the start of the roll.

SUMMARY OF THE INVENTION

The invention relates to a roll of consumer type plastic wrapping cling film having a relatively high tendency to cling to itself, the improvement comprising the leading edge portion of the film having a plurality of surface disturbances consisting of small stretch areas projecting from the surface thus forming a substantially nodulose leading edge portion which is readily identifiable and adapted for easy grasping to initiate the start of the roll. The width of the leading edge portion can vary between about 0.5 inch (1.27 cm) and about 3.0 inches (7.62 cm) for most applications and preferably between about 1.0 inch (2.54 cm) and about 2.0 inches (5.08 cm). The disturbances forming the nodulose leading edge portion of the film should be within the dimensional limits specified below for "nodulose surface".

The invention also relates to a method for imparting a nodulose contour to selected transverse areas of a film web comprising the steps:

a. aligning a rotatable drum adjacent a yieldable support surface so as to define a passage through which a continuous web of film can be fed, said rotatable drum having secured to its surface a longitudinal strip having a projected nodulose surface;

b. feeding a continuous strip of film under tension from a film supply source through said passage;

c. winding the film discharged from the passage into a roll;

d. contacting the film with the rotatable drum at preselected intervals corresponding to the transit of preselected lengths of film so that the projected nodulose surface of the strip compresses a corresponding segment of the film against the yieldable support surface thereby imparting to the film a nodulose surface contour composed of a plurality of disturbances consisting of small stretched area projections;

e. cutting the film transversely across its nodulose surface so that the cut trailing edge of the film web forms a substantial nodulose leading edge for the rolled film;

f. winding the leading edge of the remaining cut film being discharged from the passage into a new roll; and g. repeating steps (d) through (f) at least once.

The invention also relates to an apparatus for imparting a nodulose contour to selected transverse areas on a film web which comprises:

a. means for continuously feeding a strip of film from a supply source to means for winding the film into at least one roll;

b. tension means disposed proximal to and downstream of said supply source for imparting tension to the film;

c. a yieldable support surface disposed downstream of said tension means;

d. a rotatable drum aligned with the support surface so as to define a passage through which the film can pass after leaving said tension means, said rotatable drum having secured to its surface a longitudinal strip having a projected nodulose surface;

e. nipping means for periodically establishing a nipping relationship between said rotatable drum and said support surface and rotating means for rotating said rotatable drum so that after a preselected length of film is fed through said passage, the longitudinal projected nodulose surface of said strip will contact and compress the film onto the support surface, thereby imparting to a corresponding surface of the film a nodulose contour; and f. means for winding up said film in a roll after it is discharged from the passage formed by the rotatable drum and support surface.

Optionally the apparatus may be provided with the following features:

g. cutting means for severing the film after a preselected length is wound into a roll; and h. means for synchronizing said rotating means, said nipping means and said cutting means so as to align the nodulose esurface of the film with the cutting means so that the film will be severed transversely across the nodulose surface of said film, therby providing a wound roll of film having a nodulose leading edge portion.

It is to be understood that the degree of pressure required to compress the nodulose surface strip into the film which in turn is forced against the yieldable support surface to impart a permanent surface disturbance in the film consisting of a plurality of projected areas or nodules will depend on the particular material of which the film is made, the thickness of the film, the time or dwell period that the film is compressed, and the height of the projected nodules on the surface of the strip. Once the film material and the nodulose surface strip are selected, any artisan familiar with the embossing of thermoplastic films can easily determine what pressure should be applied to the strip for compressing the film into the yieldable support so as to permanently cause a disturbance in the surface of the film by imparting to the surface of the film a plurality of small stretched-area projections. It is also to be understood that in order to reduce blocking or sticking of the leading edge portion of a roll of film to its underlying layer, the plurality of stretched area projections should extend substantially and uniformly across the edge of the film and extend approximately inward at least about 0.5 inch (1.27 cm). For best results, the projected area of the disturbances or nodules should be within the dimensions as specified below and should occupy at least about 40% of the surface of the film, i.e., at least 40% of the surface area forming the edge portion of the film should be stretched into the plurality of projecting nodules.

As used herein, a nodulose surface shall mean a coarse, rough, gritty or pebbly surface composed of similar or different projected surface disturbances varying in projected height between about 0.005 inch (0.127 mm) and about 0.080inch (2.032 mm), preferably between about 0.01 inch (0.254 mm) and about 0.02 inch (0.508 mm) and more preferably about 0.016 inch (0.406 mm). In addition, each surface disturbance or nodule should have a projected area on a plane parallel to the surface of between about 19.6 square mils (0.012 square mm) and about 0.005 square inch (3.23 square mm). Example of nodulose surfaces would be emery cloth, sandpaper, embossed foil, and the like. An important criteria for the nodulose surface is that the projected surface disturbances be sufficiently hard to physically displace and stretch selected corresponding areas of the film against the support surface so as to impart a plurality of small stretch-area projections on the surface of the film. If the height of the surface disturbances exceeds 0.08 inch (2.032 mm), then using the normal conventional cling film intended for household purposes, the etched surface formed by such disturbances would probably penetrate and pierce the film thus increasing its proneness to tear or sever during the winding operation. On the other hand, if the projected height of the surface disturbances is less then 0.005 inch (0.0127 cm), the nodulose surface imparted to the film will not be distinct enough to reduce blocking or sticking of the leading edge of the film to the underlying layer when the film is wound into a consumer type roll. As used herein, the projected nodulose strip on the drum intended for use in this invention can comprise a strip of emery cloth, sandpaper, embossed foil, or the like, secured to the circumference of the drum by such means as conventional adhesive, double-sided adhesive tape, or the like. The width of the strip should be between about 1.0 inch (2.54 cm) and about 6.0 inches (15.24 cm) for most applications and preferably should be between about 2 inches (5.08 cm) and about 4 inches (10.16 cm) when intended to produce rolls of film for household use.

Cling film such as polyolefin films as disclosed in U.S. Pat. No. 3,423,274 to W. J. Lahm et al are examples of films exhibiting good cling characteristics. However, unmodified polyolfefin film may possess low slip characteristics and thus must normally have cling additives incorporated to improve or regulate its cling characteristics. Cling additives are well known in the art and include such materials as the mono-and diglycerides of fat-forming fatty acids and mixtures thereof, as described in U.S. Pat. No. 3,048,263 to Sacks et al. These additives can be incorporated in various flexible films to yield a clingable film admirably suited for use in this invention. For example, U.S. Pat. No. 3,501,363 discloses a transparent self-supporting polethylene film having cling additives of mono- and/or diglycerides of fat-forming fatty acids which have excellent cling characteristics and handleability properties. Other possible materials for use as adherent surface films include polyvinylidene chloride (PVDC), polyvinyl chloride (PVC), rubber hydrochloride, and the like. Thus it is well known in the art how to fabricate flexible cling film having a balance between effective cling properties and good handleability.

The cling film for use in this invention can range in thickness from about 0.25 mil (0.006 mm) to about 1.25 mils (0.031 mm) depending on the strength required for the particular application. Preferably, a film thickness of about 0.5 mil (0.0127 mm) is deemed suitable for most household applications.

BRIEF DESCRIPTION OF THE DRAWING

FIG. 1 is a schematic side elevation view of an apparatus employing the novel embossing elements of this invention.

FIG. 2 is an enlarged fragmentary side elevational view of the embossing station of the apparatus of FIG. 1.

FIG. 3 is a perspective view of a segment of a cling film of this invention having a nodulose surface portion.

FIG. 4 is a sectional view taken along line 4—4 of FIG. 3.

DETAILED DESCRIPTION

In FIG. 1 there is shown a schematic side view of a film wrap web winder machine of the general type disclosed in U.S. Pat. No. 3,679,010, the teachings of which are incorporated herein by reference. Specifically, the machine basically comprises a film supply station composed of a rotatable mandrel 2 which contains the film feed stock 4. The film web 6 is fed from the feed stock 4 and passed through a tension station composed of three rolls 8, 10 and 12, with rolls 8 and 10 being fixed idler rolls horizontally spaced apart and roll 12 being a variable height "dancer" roll disposed midway between and below rolls 8 and 10. The tension of the film web is controlled by the weight of the dancer roll 12 and the drive speed of the mandrel 2 which is driven by conventional motor drive means (not shown).

The film web is discharged from the tension station and fed into an embossing station comprising a yieldable support surface, such as a rotatable rubber drum or rubber covered drum 14, below which is disposed a translatable and rotatable drum 16, such as a steel drum. Secured to a longitudinal circumferential segment of the drum 16 is a strip of material 18 having a nodulose surface 19, such as sandpaper or emery cloth. The securing means could be any conventional adhesive or double-sided adhesive tape 20. Connected to the axis of drum 16 is a conventional hydraulic lift cylinder 22 which is synchronized by conventional means such as a timer (not shown). Actuation of the hydraulic lift cylinder 22 will project or lift drum 16 toward drum 14. As shown in the enlarged view of the embossing station in FIG. 2, when the drum 16 is projected upward toward support drum 14, the nodulose surface strip 18 secured to the circumference of drum 16 forced against film web 6 disposed in passage 15 formed between support drum 14 and drum 16 thereby compressing the film into the support drum 14. Each of the projected surface disturbances forming the nodulose surface of strip 18 contacts and stretches a corresponding surface area of the film into the rubber support drum 14 thereby imparting to film 6 a plurality of permanent surface disturbances composed of small stretched areas 21 projecting form the surface of the film 6 as shown in FIGS. 3 and 4. When the film is intended to be rolled on cores and packed in conventional dispensing cartons for household use, the height and projected surface area of each of the projected disturbances should be within the range as specified above.

Draw rolls 28 and 30 pull the film web 6 from passage 15 over idler spreader rolls 24 and 26. The film web 6 is then fed over roll 32 which contains cutting means (not shown) for severing the film lengthwise into two or more equal segments. The longitudinal cut film web is further fed to roll 34 where it is then dispensed and wound onto a core 36 mounted on a rotatable mandrel (not shown) which is disposed on a translatable and rotatable turret 38. As shown in FIG. 1, turret 38 has six cores 36, 40, 42, 44, 46 and 48. The turret is operable such that when it is disposed to the left of roll 34 (this position not shown), it is in a position for receiving a desired length of film 6 for winding on core 36, said core 36 being rotated in the direction shown and being disposed adjacent a rider idler roll 52. After a desired length of film is wound on core 36, the turret 38 is moved to the right as shown in FIG. 1 where a knife 50 severs transversely the film 6 across the nodulose surface 23 thereby completing the winding of the film 6 on core 36. Immediately upon severing the film, the turret 38 is moved to the left and rotated clockwise thereby advancing core 48 in postion for receiving the leading edge of the remaining film web 6. The synchronization of the turret 38 with the drive feed means for the film 6 (not shown) is conventional and is disclosed, for example, in U.S. Pat. Nos. 3,266,744, 3,350,027 and 3,679,010,the teachings of which are incorporated herein by reference.

The actuation of the hydraulic cylinder 22 is timed by conventional means (not shown) so as to impart a nodulose surface to the film web 6 at a location that will be subsequently severed by the cutting knife 50 so as to provide a nodulose leading edge portion for a fully wound roll of film, said leading edge portion having a plurality of surface disturbances consisting of small stretched areas projecting from the surface and being adapted for easy grasping to initiate the start of the roll.

One of the major benefits of this invention is that if the actuation of the embossing roll 16 gets out of synchronization with the cutting means 50 so that the film web is not severed transversely at the nodulose surface of the film, then the apparatus can be shut down and in a few minutes the nodulose surface strip can be removed and repositioned so as to restore proper synchronization between the embossment and severing operations. In addition, the nodulose surface strip is a relatively inexpensive item that can easily be replaced when worn out.

EXAMPLE 1

A 81 inch Poly Rewinder Machine 4769 obtained from the Paper Converting Machine Company, Inc. of Green Bay, Wis. was modified mainly to the extent that the conventional heated etched platen on the emboss drum was replaced with three strips of emery cloth sized 40, 60 and 80grit. Each of the strips of emery cloth measured 3 inches in width and each was secured to the emboss drum using a double-sided adhesive tape, said strips spaced apart approximately one inch. the modified machine was as shown in FIG. 1 and used a 62-inch (157.5 cm) wide roll of polyethylene film as the supply roll. Following the sequence as discussed above, the film web was then fed over a rubber support drum and after passage of 99feet (29.7 meters), the emboss drum was activated thereby compressing the film against the support drum and imparting to the film web three distinct nodulose contours each being three inches in width. The film web was severed longitudinally into five segments and then fed onto cores in the manner as described above in conjunction with FIGS. 1 and 2. After 100 feet (30 meters) of film were rolled on the cores, the cutting means of the machine severed the film. This procedure was continued until 200 rolls of film were produced. The rolls were examined and it was found that the substantially nodulose surfaces of each roll of film were readily identifiable and suitable for easy grasping since the cling characteristics of the film at these surfaces were reduced. Of the three nodulose surfaces on each roll of film, the nodulose surface produced by the 40 grit emery cloth was found to be slightly better for grasping than the nodulose surfaces produced by the 60 grit and 80 grit emery cloths.

EXAMPLE 2

A 81 inch Poly Rewinder Machine 4769 obtained from the Paper Converting Machine Company, Inc. of Green Bay, Wisconsin was modified mainly to the extent that the conventional heated etched platen on the emboss drum was replaced with a three inch wide strip of 40 grit size emery cloth (No. 40 Grit Carboundum Emery Cloth produced commercially by the 3M Company). The strip of emery cloth was secured to the emboss drum using a double-sided adhesice tape. The modified machine was as shown in FIG. 1 and used a 62-inch (157.5 cm) wide roll of polyethylene film as the supply roll. Following the sequence as discussed in FIGS. 1 and 2, the film web was then fed over a rubber support drum and after passage of 99.9 feet (29.97meters), the emboss drum was activated thereby compressing the film against the support drum and imparting to the film web a 3-inch wide nodulose surface. The film web was severed longitudinally into five segments and then fed onto cores in the manner as described above. After 100 feet (30 meters) of film were rolled on the cores, the cutting means of the machine severed transversely the film approximately at the center of the nodulose surface of the film. This procedure was continued until 200 rolls of film were produced. The rolls were examined and it was found that the substantially nodulose surface of each roll of film was readily identifiable and adapted for easy grasping to initiate the dispensing of the film off the roll.

The rolls as taught herein are contemplated particularly for use with standard one-use, consumer type dispensing carton, in the known manner. Exemplary of such cartons would be the trunk lid style carton as typified by the cartons shown in U.S. Pat. Nos. 2,069,837, 2,226,477, 3,118,581, 3,129,870, and 3,549,066, and the conventional flap lid style carton which is illustrated in certain various forms thereof in U.S. Pat. Nos. 1,972,069, 2,433,445, 2,463,375, 2,472,521, 2,624,501, and 2,888,181. These patent teachings are hereby incorporated herein by reference.

It should be understood that the foregoing disclosure relates to preferred embodiments of the invention, and it is intended to cover all changes and modifications of the invention which do not depart from the spirit and scope of the appended claims.

What is claimed is:

1. In a roll of consumer type plastic wrapping cling film having a relatively high tendency to cling to itself, the improvement comprising the leading edge portion of the film having a plurality of surface disturbances consisting of small stretched areas projecting from the surface of the film thus forming a substantially nodulose leading edge portion which is readily identifiable and adapted for easy grasping to initiate start of the roll.

2. The roll of cling film of claim 1 wherein the width of the nodulose leading edge portion is between about 0.5 inches (1.27 cm) and about 3 inches (7.62 cm).

3. The roll of cling film of claim 1 wherein the surface disturbances forming the substantially nodulose leading edge project above the surface of the film by between about 0.005 inch (0.127 mm) and about 0.08 inch (2.03 mm).

4. The roll of cling film of claim 1 wherein each disturbance projecting form the leading edge portion has a projected area on a plane parallel to the surface of the film of between about 19.6 square mils (0.012 square cm) and about 0.005 square inch (3.23 square cm).

* * * * *

UNITED STATES PATENT OFFICE

CERTIFICATE OF CORRECTION

Patent No. 4,029,264 Dated June 14, 1977

Inventor(s) R. G. Reese

It is certified that error appears in the above-identified patent and that said Letters Patent are hereby corrected as shown below:

Column 7, line 24, the word "the" should be -- The --.

In claim 4, line 2, the word "form" should be -- from --.

Signed and Sealed this

*Fourteenth* Day of *February 1978*

[SEAL]

*Attest:*

RUTH C. MASON
*Attesting Officer*

LUTRELLE F. PARKER
*Acting Commissioner of Patents and Trademarks*